US005505447A

United States Patent [19]

Mockovak

[11] Patent Number: 5,505,447

[45] Date of Patent: Apr. 9, 1996

[54] GOLF PUTTER WITH FLEXIBLE HOSEL

[76] Inventor: Richard M. Mockovak, 1995 W. 116th St., Carmel, Ind. 46032

[21] Appl. No.: 407,500

[22] Filed: Mar. 17, 1995

Related U.S. Application Data

[63] Continuation-in-part of Ser. No. 319,426, Oct. 6, 1994, abandoned.

[51] Int. Cl.[6] ..... A63B 53/02

[52] U.S. Cl. ..... 273/80.2; 273/80 C; 273/167 G

[58] Field of Search ..... 273/80 R, 80 G, 273/80.1, 80.2, 80.3, 80.4, 80.5, 80.6, 80.7, 80.8, 80.9, 167 R, 167 D, 167 F, 167 G, 77 R, 167 K, 169, 164.1, 163 R, 80 B; D21/221

[56] References Cited

U.S. PATENT DOCUMENTS

| | | | |
|---|---|---|---|
| D. 217,873 | 6/1970 | Steele | 273/80.1 |
| D. 223,031 | 2/1972 | Ernst | 273/167 G |
| 687,540 | 11/1901 | Palmer | 273/80.2 |
| 1,116,417 | 11/1914 | Hackbarth . | |
| 1,154,490 | 9/1915 | Davis . | |
| 1,952,624 | 3/1934 | Inman | 273/167 R |
| 2,057,275 | 10/1936 | McKenna | 273/77 |
| 2,470,406 | 5/1949 | Matzie | 273/80.3 |
| 2,644,689 | 7/1953 | Putnam | 273/79 |
| 3,419,275 | 12/1968 | Winkleman | 273/171 |
| 3,516,674 | 6/1970 | Scarborough | 273/169 |
| 3,519,270 | 7/1970 | Baymiller | 273/80 |
| 3,992,015 | 11/1976 | Benson | 273/80.2 |
| 4,147,357 | 4/1979 | Strop | 273/164.1 |
| 4,948,132 | 8/1990 | Wharton | 273/80.1 |
| 4,951,949 | 8/1990 | Kastenhuber | 273/80.1 |
| 4,991,843 | 2/1991 | Mori | 273/80.8 |
| 5,160,144 | 11/1992 | Maniatis | 273/186.2 |
| 5,273,280 | 12/1993 | Lo | 273/80.8 |
| 5,314,184 | 5/1994 | Schmidt et al. | 273/164.1 |

FOREIGN PATENT DOCUMENTS

| | | | |
|---|---|---|---|
| 558183 | 1/1975 | Switzerland | 273/80 C |
| 2230461 | 10/1990 | United Kingdom | 273/167 R |
| WO8403447 | 9/1984 | WIPO | 273/81 B |

*Primary Examiner*—Sebastiano Passaniti
*Attorney, Agent, or Firm*—Woodard, Emhardt, Naughton, Moriarty & McNett

[57] ABSTRACT

A golf putter having a flexible hosel between the shaft and the blade. A rigid canopy covers the distal end of the shaft and the proximal end of the hosel, thereby coupling the two. The hosel may be split into two flanges or may be a single, solid piece and is preferably made of graphite or spring steel. When the blade strikes the golf ball, the hosel is deformed and thereby stores energy from the stroke which is normally lost to noise, shaft vibration and blade rebound. The spring nature of the hosel returns the deformed hosel to its quiescent state, thereby imparting the stored energy to the ball in the line of the putt. The amount of deformation experienced by the hosel is controlled by the amount of the hosel covered by the canopy.

39 Claims, 7 Drawing Sheets

GOLF PUTTER WITH FLEXIBLE HOSEL

CROSS-REFERENCE TO RELATED APPLICATIONS

The present application is a continuation-in-part of United States patent application Ser. No. 08/319,426, filed Oct. 6, 1994 now abandoned.

TECHNICAL FIELD OF THE INVENTION

The present invention relates to golf clubs, and more particularly to golf putters having flexible hosels.

BACKGROUND OF THE INVENTION

In golf, the putting game is a game of small distances and minimum tolerance for error. In putting, minimal errors in speed and direction of the putter head as it contacts the ball are magnified as the ball progresses towards the hole, causing errant putts and adding strokes to the golfer's score. It has long been recognized by golfers that the putting stroke is more critical and more demanding than the driving stroke. For example, if a golf ball is to be driven 200 yards and the head of the club is misaligned by two degrees, the ball will miss its intended target by seven yards. When aiming for the middle of the fairway, an error of seven yards is not critical. However, when putting a distance of ten feet and aiming at the cup which is approximately four and one-half inches in diameter, a misalignment error of two degrees will cause the ball to miss the rim of the cup by one and three-quarter inches resulting in a missed putt and an extra stroke for the hole.

When a golfer is preparing to putt, he assesses the lie of the golf green and the path that the ball must travel in order to reach the cup. The putter is then swung in the direction the ball is to travel so that the ball striking face of the putter blade makes contact with the ball and propels it in the desired direction with the appropriate velocity. Errant putts can be caused when the desired path the putter is to travel is deviated from. The farther the golfer must swing the putter, the more likely the putter is to deviate from the desired path. Therefore, any putter design which allows a shorter putter stroke will produce more accurate putting results.

Also, most prior art putters cause the ball to become airborn when it is hit, making the ball susceptible to bouncing off line when it lands. Therefore, any putter design which keeps the ball on the ground longer will produce more accurate putting results. Additionally, it is desirable that a putter design produce an overspin on the ball when it is hit, which will help to keep the ball on the intended line.

Furthermore, much of the energy in the stroke of prior art putters is wasted in the inelastic collision of the prior art putter with the ball, which turns the stroke energy into noise, shaft vibration, and rebound of the putter blade in a reverse direction. Such blade rebound actually works against the golfer's follow through. Anticipation of this collision can even cause the golfer to unconsciously tense his muscles just at the critical moment before contact with the ball, disrupting the line of the stroke and the resulting path of the ball.

It is therefore desirable to find a putter which maximizes the roll distance of the ball resulting from any given stroke, a putter which creates more overspin on the ball, a putter which conserves stroke energy by minimizing the production of noise, shaft vibration and rebound of the putter blade, and a putter which exhibits a "soft hit", allowing for smooth, continuous and uninterrupted flow from the stroke to the follow through. The present invention is directed toward meeting these needs.

SUMMARY OF THE INVENTION

The present invention relates to a golf putter having a flexible hosel between the shaft and the blade. A rigid canopy covers the distal end of the shaft and the proximal end of the hosel, thereby coupling the two. The hosel may be split into two flanges or may be a single, solid piece, and is preferably made of graphite or spring steel. When the blade strikes the golf ball, the hosel is deformed and thereby stores energy from the stroke which is normally lost to noise, shaft vibration and blade rebound. The spring nature of the hosel returns the deformed hosel to its quiescent state, thereby imparting the stored energy to the ball in the line of the putt. The amount of deformation experienced by the hosel is controlled by the amount of the hosel covered by the canopy.

In one form of the invention, a golf putter is disclosed, comprising a shaft; a blade; a split hosel coupling the shaft and the blade; and a canopy enclosing a first portion of the shaft and a first portion of the split hosel whereby adjustment of the extent of the canopy over the first portion of the split hosel varies the dynamic characteristics of the split hosel; wherein the split hosel is formed from a resilient material which deforms when the blade strikes a ball and transfers energy to the ball when the split hosel returns to its quiescent position.

In another form of the invention a golf putter is disclosed, comprising a shaft; a blade: a split hosel having a first and second flange, wherein the hosel is coupled to the shaft and the first and second flanges are coupled to the blade; and a canopy enclosing a first portion of the shaft and a first portion of the split hosel whereby adjustment of the extent of the canopy over the first portion of the split hosel varies the dynamic characteristics of the split hosel.

In another form of the invention, a golf putter is disclosed, comprising: a shaft; a face balanced blade; a split hosel having a first and second flange, wherein the hosel is coupled to the shaft and the first and second flanges are coupled to the blade such that the putter is center shafted; and a canopy enclosing a distal end of the shaft and a proximal end of the split hosel whereby adjustment of the extent of the canopy over the proximal end of the split hosel varies the dynamic characteristics of the split hosel; wherein the split hosel is formed from a resilient material which deforms when the blade strikes a ball and transfers energy to the ball when the split hosel returns to its quiescent position; and wherein a first bending radius of the first flange is equal to a second bending radius of the second flange.

In another form of the invention a golf putter is disclosed, comprising a shaft; a blade; a hosel coupling the shaft and the blade; and a canopy enclosing a first portion of the shaft and a first portion of the hosel whereby adjustment of the extent of the canopy over the first portion of the hosel varies the dynamic characteristics of the hosel; wherein the hosel is formed from a resilient material which deforms when the blade strikes a ball and transfers energy to the ball when the hosel returns to its quiescent position.

In another form of the invention a golf putter is disclosed, comprising a shaft; a blade; a hosel, wherein the hosel is coupled to the shaft and to the blade; and a canopy enclosing a first portion of the shaft and a first portion of the hosel whereby adjustment of the extent of the canopy over the first portion of the hosel varies the dynamic characteristics of the hosel.

In another form of the invention a golf putter is disclosed, comprising a shaft; a face balanced blade; a hosel, wherein the hosel is coupled to the shaft and to the blade such that the putter is center shafted; and a canopy enclosing a distal end of the shaft and a proximal end of the hosel whereby adjustment of the extent of the canopy over the proximal end of the hosel varies the dynamic characteristics of the hosel; wherein the hosel is formed from a resilient material which deforms when the blade strikes a ball and transfers energy to the ball when the hosel returns to its quiescent position.

DESCRIPTION OF THE PREFERRED EMBODIMENT

Figure 1:
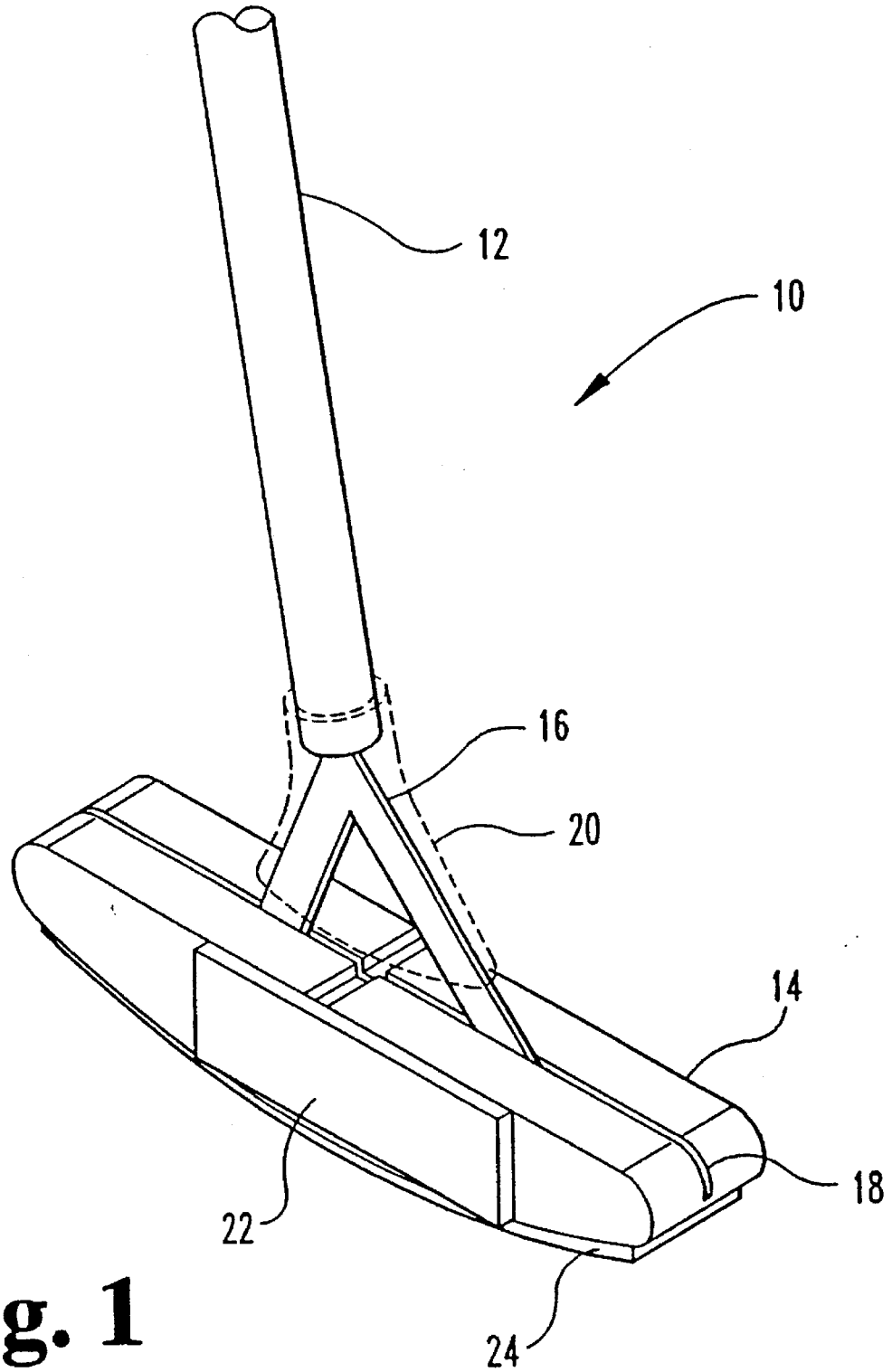
FIG. 1 is a perspective view of a first embodiment putter of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A first embodiment of the golf putter of the present invention is illustrated in FIG. 1 and indicated generally at 10. The putter 10 comprises a shaft 12 coupled to a putter blade 14 by a split hosel 16. The shaft 12 may be constructed from any material known in the art such as metal or graphite. The blade 14 may also be constructed from any material known in the art such as brass. The split hosel 16 is constructed from a material which will return to its quiescent state after being deformed, such as spring steel or graphite. The proximal end of the split hosel 16 includes a stub (not shown) which extends into the distal end of the shaft 12. The two distal flanges of the split hosel are coupled to the blade 14 by any convenient method, such as gluing them into the groove 18. The two flanges of the split hosel 16 are preferably connected by a cross-member (see FIG. 2) at their distal extremes in order to provide a more secure coupling to the blade 14 and to enhance torsional rigidity. The hosel 16 therefore is in the shape of an open-centered triangle. The hosel 16 may be stamped from a sheet of spring steel or formed by any other means known in the art. The lower portion of the shaft 12 and the upper portion of the split hosel 16 are covered by a canopy 20. The canopy 20 functions to hold the shaft 12 to the split hosel 16 and also to set the dynamic characteristics of the split hosel 16, as will be described in more detail hereinbelow. The canopy 20 may be formed from any suitable material, such as epoxy, plastic, metal or any other material which will allow the canopy 20 to perform the function described hereinbelow. The canopy 20 may be formed in situ or formed separately and assembled with the putter 10. The canopy 20 may be a single piece or may be assembled from two or more separate pieces.

The blade 14 is preferably face balanced, meaning that the center of gravity of the blade 14 is in the geometrical center of the ball striking face. It is additionally favorable that the center of gravity of the blade 14 lie between the two flanges of the split hosel 16. An additional weight 22 may optionally be added to the blade 14 by placing the weight 22 on the non-ball striking face in such a way as to maintain the center of gravity of the blade 14 in the desired location. A spacer 24 may also optionally be provided on the bottom of the blade 14. The spacer 24 functions to raise the center of gravity of the blade 14 to the desired position for striking the golf ball. Because the maximum diameter of a golf ball is 1.6 inches, it is preferable that the center of gravity of the blade 14 be positioned at 0.8 inches above the ground when putting.

Figure 2:
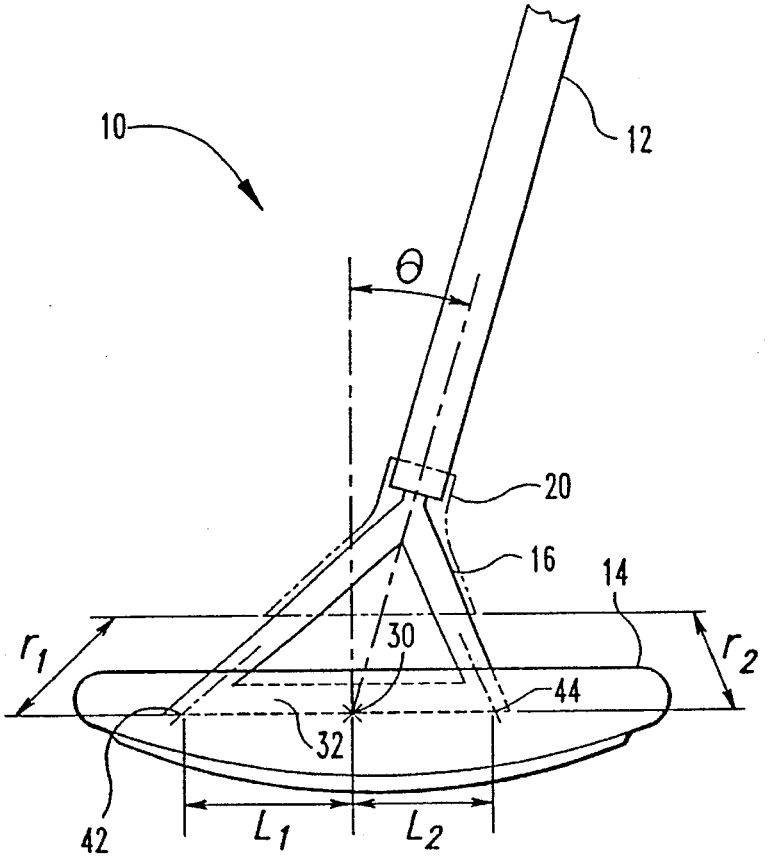
FIG. 2 is a side elevational view of the first embodiment putter of the present invention.

Referring now to FIG. 2, the golf putter 10 is illustrated in a side elevational view. The center of gravity of the blade 14 lies at the point 30. The cross-member 32 coupling the flanges of the split hosel 16 is visible in this view. The putter 10 of the present invention is preferably center shafted, meaning that the axis of the shaft 12 passes through the center of gravity 30. The axis of the shaft 12 is also inclined from the vertical by the angle θ. The rules of the United States Golf Association require that the angle θ be at least 10 degrees for a putter, and in the preferred embodiment of the present invention, the angle θ is 20 degrees.

When the putter 10 is swung and makes contact with the golf ball, a rebound force will be created, tending to push the putter blade 14 against the direction of the stroke and away from the ball. In the prior art, this rebound force resulted in noise, shaft vibration, and in some cases a rebound of the putter blade away from the ball. All of these prior art putter attributes are undesirable because they transform energy, in the stroke into physical phenomena which do not propel the golf ball toward the cup. In other words, the energy is wasted. In order to compensate for this wasted energy, the golfer using a prior art putter must use a harder stroke, making it more likely that the golfer's wrists will come into play and thereby increasing the potential for hitting the ball off line. In contrast to the prior art putters, the putter 10 of the present invention absorbs much of the previously wasted energy and reapplies the energy to the ball in the proper line.

Figure 3:
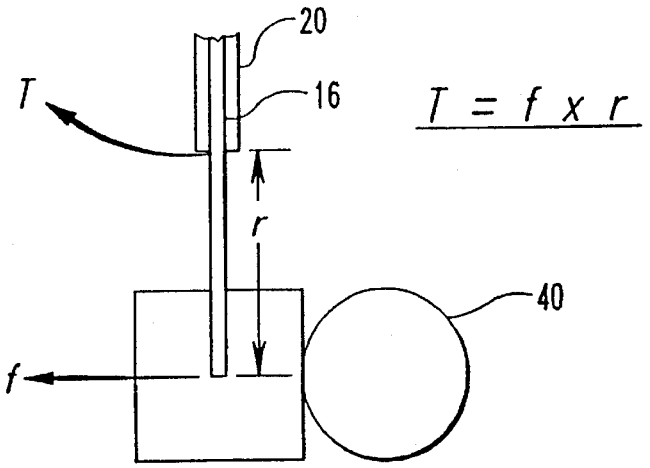
FIG. 3 is a cross-sectional schematic diagram of the putter of the present invention striking a golf ball.

Referring to FIG. 3, the putter 10 is illustrated in schematic cross-section at the moment of striking a golf ball. 40. The putter blade 14 is seen on end, with the stroke of the putter being from left to right in the figure. At the moment of contact with the ball 40, a rebound force f is produced in the putter blade 14. Because the shafts of prior art putters were rigidly fixed to the blade, the force f could only be dissipated as noise, shaft vibration or an actual rebound of the putter blade away from the ball. In the putter 10 of the present invention, however, the shaft 12 is not rigidly fixed to the blade 14, but is instead coupled by the flexible split hosel 16. The force f therefore creates a twisting torque T at the point of intersection between each flange of the split hosel 16 and the bottom of the canopy 20. The magnitude of the twisting torque is dependent upon the magnitude of the force f, as well as the distance r from the point of application of the force f and the pivot point at the intersection of the hosel 16 flange and the canopy 20. The magnitude of the torque is given by the equation:

$$T=f\times r$$

It will be appreciated by those skilled in the art that for any given force f (i.e. any given stroke speed), the torque T (or bending force) applied to the spring steel or graphite hosel 16 is directly proportional to the bending radius r through which the force acts. This torquing energy bends the hosel 16, the spring nature of which stores most of this energy. When the spring nature of the spring steel returns the hosel 16 to its quiescent state, the energy stored therein is imparted back to the ball 40, thereby giving it extra speed in the line of the putt. Much of the energy normally lost to noise, shaft vibration and blade rebound is therefore recovered by tbe split hosel 16 of the present invention and redirected to the ball 40 in the same direction as the original stroke. It follows that a shorter, softer stroke may then be used for any given putt.

It is important that the hosel 16 not be too pliant. The hosel 16 should be resilient enough that the return to its quiescent position occurs while the ball 40 is still m contact with the blade 14 face, so that the stored energy may be applied to the ball 40. If the hosel 16 is too slow in returning to its quiescent position, the ball 40 will have already separated from the face of the blade 14, and the energy stored in the hosel 16 may not be applied to the ball 40.

Because the torque applied to the hosel 16, and hence the amount of energy stored therein, is proportional to the bending radius, the energy absorption, storage, and redelivery characteristics of the putter 10 may be adjusted by varying the amount of the hosel 16 covered by the canopy 20. This is because the pivot point of the hosel 16 flanges is at the intersection of the hosel 16 with the bottom of the canopy 20. The radius r therefore extends from the plane of contact between the blade 14 and the ball 40 to the bottom of the canopy 20. By adjusting the extent of the canopy 20 over the hosel 16, the radius r may be made lesser or greater. By this action, the torque T is made proportionately lesser or greater.

Referring once again to FIG. 2, it will be appreciated by those skilled in the art that it is important that an equal torque be applied to each of the flanges of the hosel 16 when the ball 40 strikes the blade 14. Unequal torques will cause one of the flanges of the hosel 16 to deform more than the other flange, thereby producing a twist in the blade 14. Not only does this result in the face of the blade 14 no longer being aligned perpendicular to the line of play, but it also results in more energy being stored in the misaligned flange, thereby causing the blade 14 to twist back in the opposite direction when the stored energy is redelivered to the ball. This action will tend to push the ball 40 off the desired line of the putt. In the putter 10 of the FIG. 2, the distance $r_1$ is greater than the distance $r_2$. In order to prevent unequal torques from acting on the two flanges of the hosel 16, it is therefore necessary that the force components at the points 42 and 44 be unequal. If the ball 40 is to be struck at the center of gravity 30, it is therefore necessary that the distance $L_1$ be greater than the distance $L_2$ in a proportion large enough to compensate for the disparity in the distances $r_1$ and $r_2$. By adjusting these relative distances, it is therefore possible to produce equal bending torques on both flanges of the split hosel 16, thereby insuring there will be no twist in the blade 14 when the ball 40 is struck at the center of gravity 30.

Figure 4:
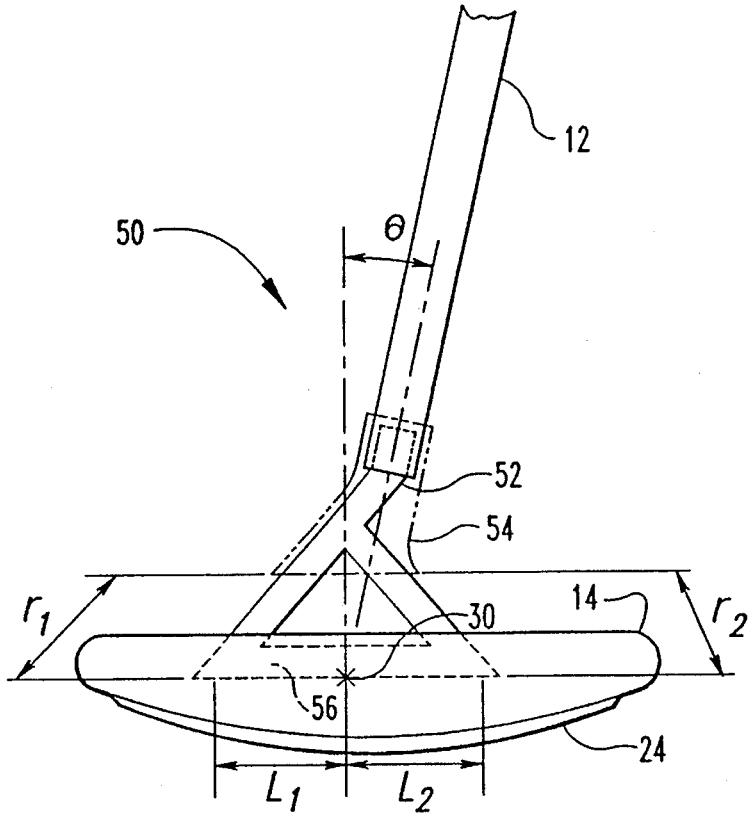
FIG. 4 is a side elevational view of a second embodiment putter of the present invention.

Referring now to FIG. 4, a second embodiment of the present invention is illustrated and indicated generally at 50. The shaft 12 of the putter 50 is coupled to a split hosel 52 by means of a canopy 54. An optional cross-member 56 couples the flanges of the split hosel 52. The hosel 52 is formed in such a manner that distance $r_1$ equals the distance $r_2$ and the distance $L_1$ equals the distance $L_2$. This is accomplished, by making the flanges of the hosel 52 symmetrical about the vertical center line 56 of the center of gravity of the blade 14. Because of the symmetrical nature of the putter 50, no twist in the face 14 will be created when the ball is struck at the point 30 coinciding with the center of gravity of the blade 14. This is because the torque experienced by each of the hosel 52 flanges will be equal.

Figure 5:
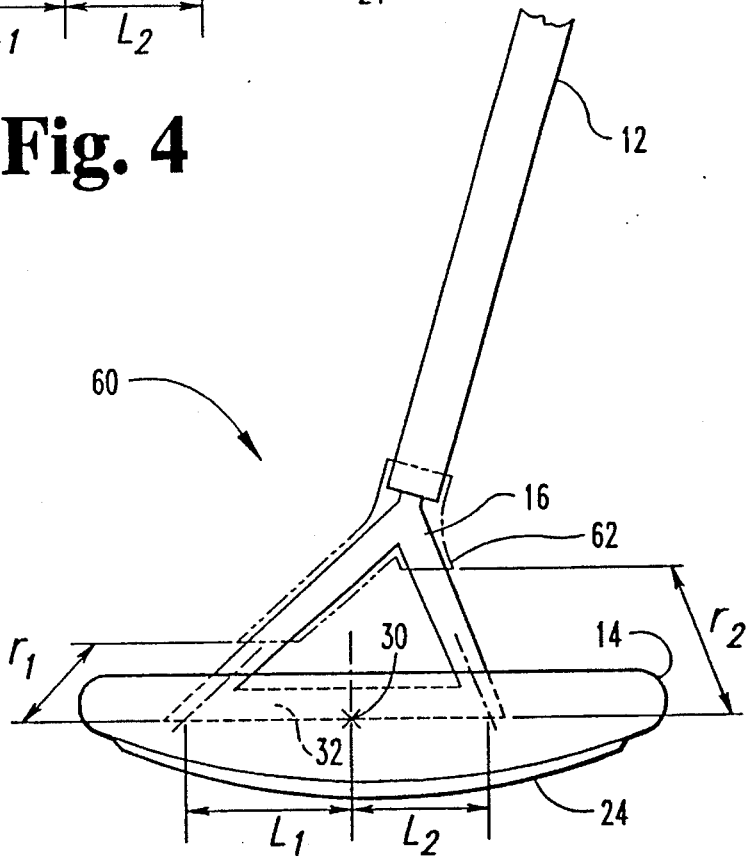
FIG. 5 is a side elevational view of a third embodiment putter of the present invention.

Referring now to FIG. 5, a third embodiment putter of the present invention is illustrated and indicated generally at 60. The putter 60 includes the same shaft 12, hosel 16 and blade 14 as the putter 10, the difference being that the canopy 62 is formed to have two non-symmetrical legs which extend differing distances down the two flanges of the hosel 16. The canopy 62 is formed in such a manner as to make the bending radius $r_1$ equal to the bending radius $r_2$. With this arrangement, the distance $L_1$ may be made equal to the distance $L_2$, and equivalent bending torques will be produced in each of the flanges of the split hosel 16, thereby insuring that the blade 14 will not twist when the ball 40 is struck at the center of gavity 30.

Figure 6:
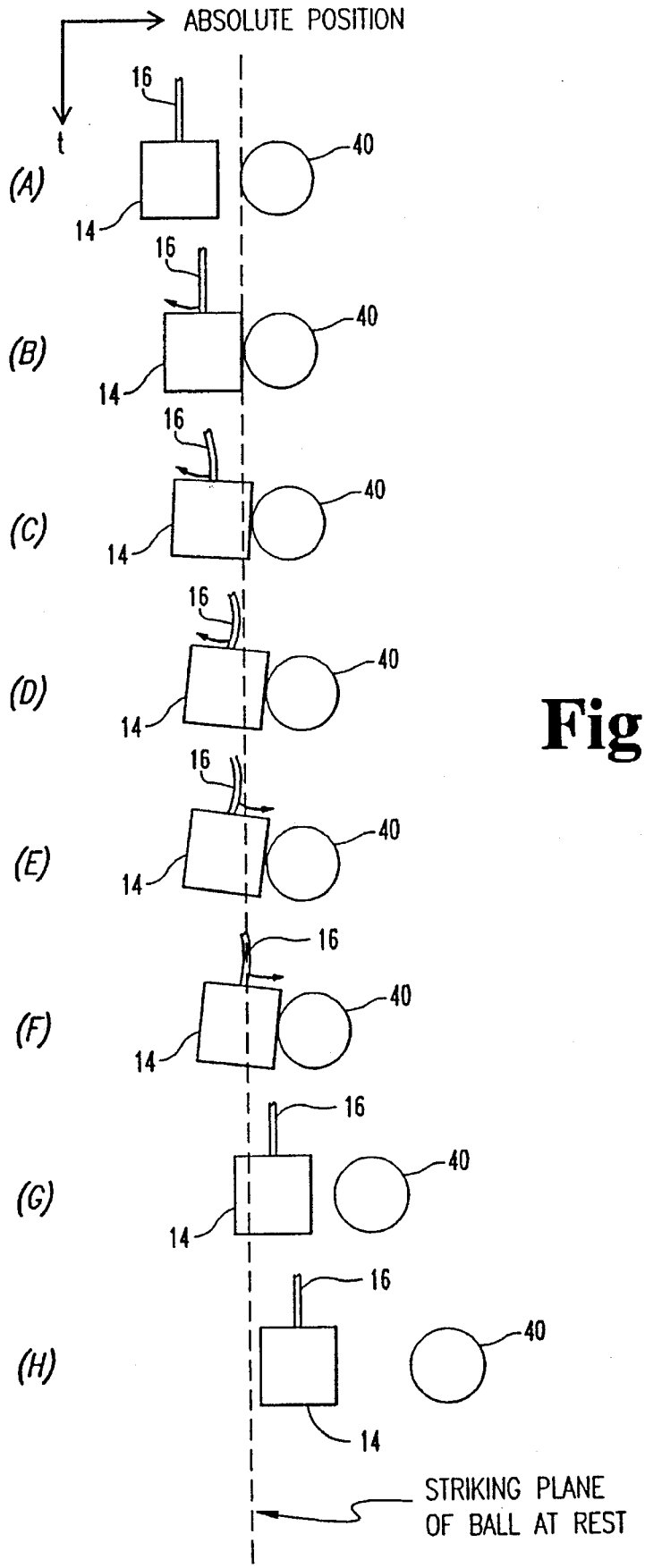
FIG. 6 shows cross-sectional schematic diagrams of a putter of the present invention approaching, striking, and propelling a golf ball.

Referring now to FIGS. 6A–H, the movement of the hosel 16 is illustrated as the blade 14 strikes a ball 40. In FIG. 6A, the blade 14 is being stroked from left to right and has not yet made contact with the ball 40. The hosel 16 remains straight and undeformed. In FIG. 6B, the blade 14 has just made contact with the ball 40, and the torque produced in the hosel 16 begins to bend it to the left. In FIG. 6C, the impact of the blade 14 with the ball 40 has begun to move the ball 40 to the right. The blade 14, however, remains in contact with the ball 40 and the rebound force created by the collision continues to further deform the hosel 16. In FIG. 6D, the ball 40 has moved further to the right, however the blade 14 remains in contact as it continues its stroke from left to right. The hosel 16 is now at its point of maximum deflection. In FIG. 6E, the spring nature of the hosel 16 now begins to return the hosel 16 to its quiescent state pushing the blade 14 to the right and further accelerating the ball 40. In FIG. 6F, the hosel 16 continues its straightening to its quiescent state, further pushing the ball 40 with the blade 14. In FIG. 6G the hosel 16 has returned to its quiescent state and the force of the stroke as well as the force of the hosel 16 returning to its quiescent state has propelled the ball 40 to the right and out of contact with the blade 14. In FIG. 6H, the blade 14 continues moving to the right in the golfer's follow through even though the ball 40 is no longer in contact with the putter and is moving in line with the putt.

It will be appreciated by those skilled in the art that the deformation of the hosel 16 and its return to its quiescent state, as illustrated in FIGS. 6B–F impart a whip-like action to the blade 14 which results in acceleration of the ball 40 at a greater rate than would be the case with the prior art rigid hosel. Not only does this result in a shorter and softer stroke being necessary for any desired putt, but the resulting "soft hit" feel of the putter of the present invention results in a much smoother stroke and follow through, making it more likely that the golfer's wrists will not come into play and the ball will be putted on the desired line.

Furthermore, as the hosel 16 is deformed, the contact point between the blade 14 and the ball 40 rises above the center of gravity of the ball 40. The hosel's stored energy is therefore applied to the ball 40 above its center line (as illustrated in FIGS. 6E–F). resulting in a desirable topspin on the ball 40. Such topspin will increase the distance traveled by the ball 40 and tend to make the ball 40 hold the line of the putt.

It will be further appreciated by those skilled in the art that by selecting the amount of the hosel flanges which remain exposed below the bottom edge of the canopy, the flexibility of the hosel can be adjusted. By adjusting the flexibility of the hosel, the energy storage and return characteristics of the putter may be adjusted.

Figure 7:
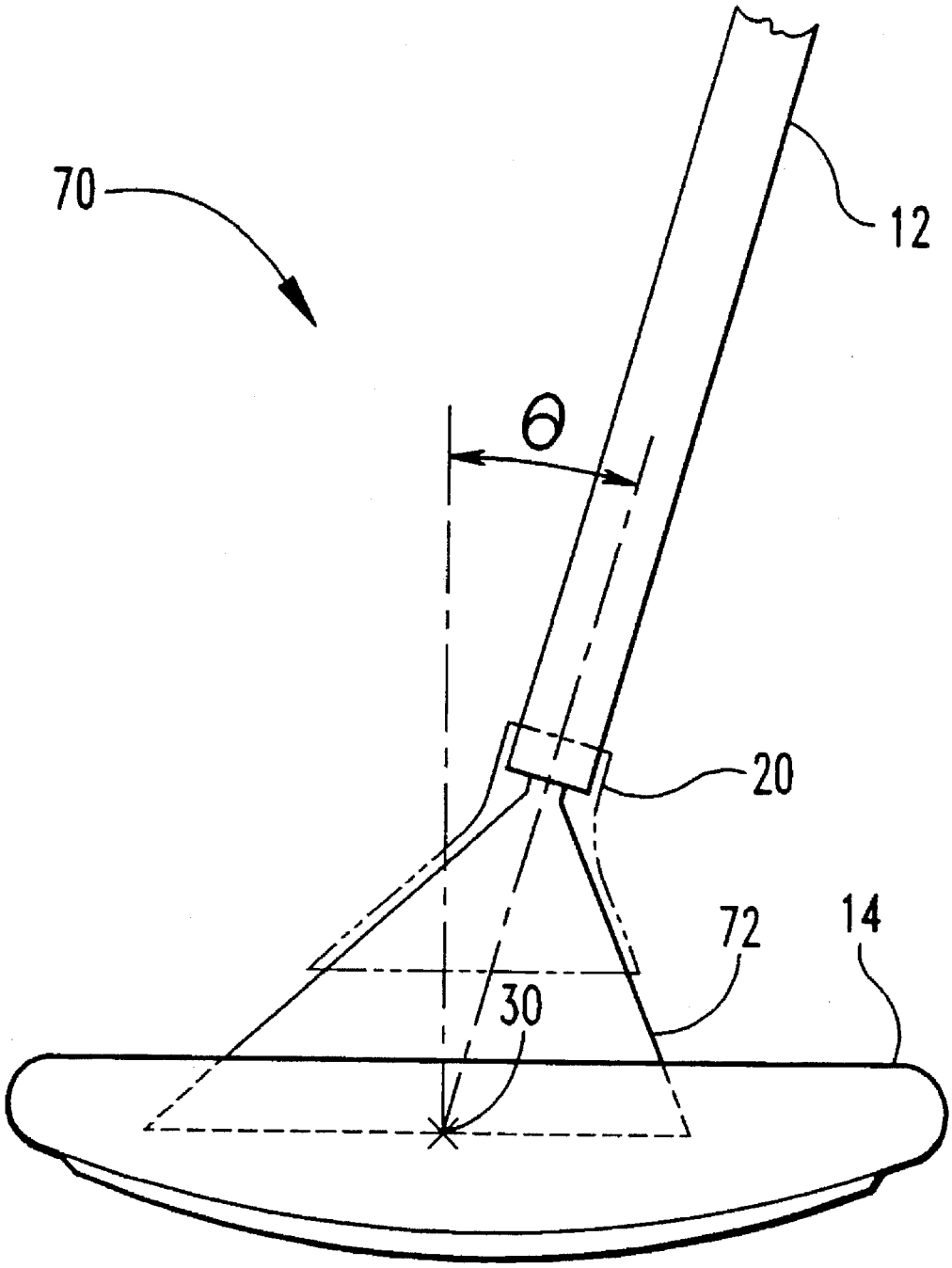
FIG. 7 is a side elevational view of a fourth embodiment putter of the present invention.

Referring now to FIG. 7, there is illustrated a fourth embodiment of the present invention, indicated generally at 70. The putter 70 is similar to putters 10 and 60 with the exception that the putter 70 includes a hosel 72 which is formed as a solid triangular piece, preferably from spring steel or graphite. In all other respects, the putter 70 is identical to the putters 10 and 60. Because the hosel 72 is a single solid piece, the hosel 72 bends across the entire length of the intersection with the bottom of the canopy 20 when the putter blade 14 makes contact with the golf ball. The amount of deformation of the hosel 72 produced by collision with the golf ball can be controlled by varying the extent that the canopy 20 extends down over the hosel 72. Furthermore, the formation of the hosel 72 in a single piece rather than in two flanges, minimizes the propensity of the blade 14 to twist when the golf ball is not struck exactly at the center of gravity 30.

Figure 8:
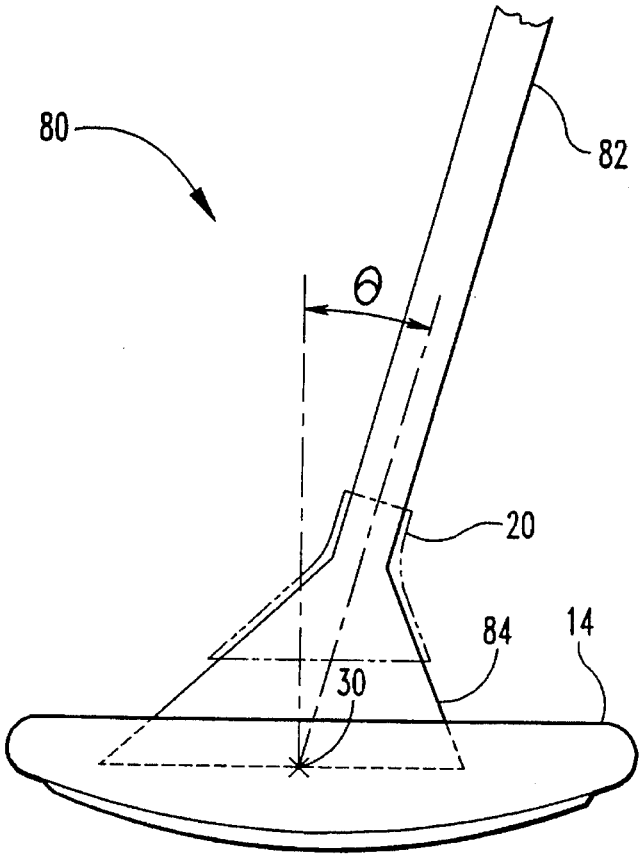
FIG. 8 is a side elevational view of a fifth embodiment putter of the present invention.

Referring now to FIG. 8, there is illustrated a fifth embodiment of the present invention, indicated generally at 80. Like the putter 70, the putter 80 has a hosel 84 formed as a single solid triangular piece. However, in the putter 80, the shaft 82 is formed as an integral unit with the hosel 84. In a preferred form, the shaft 82 and the hosel 84 are both formed graphite, and are formed as a single unit or are formed as two separate units and later spliced together to form an integral piece. As with the putter 70, the putter 80 includes a canopy 20 which is positioned over the transition area between the shaft 82 and the hosel 84. The functioning of the putter 80 is identical to the functioning of the putter 70 as described hereinabove.

Figure 9:
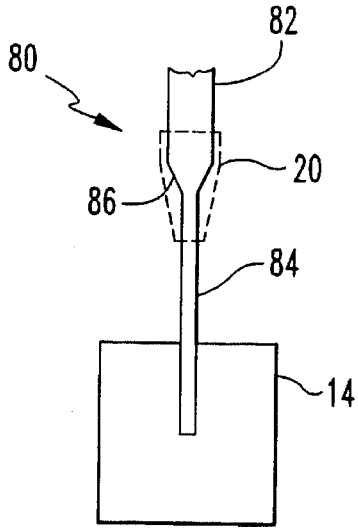
FIG. 9 is a cross-sectional schematic diagram of the fifth embodiment putter of the present invention.

The putter 80 is illustrated in schematic cross-section in FIG. 9. In this view. it will be appreciated by those skilled in the art that the interface between the graphite shaft 82 and the graphite hosel 84 includes a transition area 86 in which the shaft 82 dimensions smoothly transition to the hosel 84 dimensions. Similarly, the dimension of the canopy 20 follows the dimensions of the shaft 82/transition area 86/hosel 84.

Figure 10:
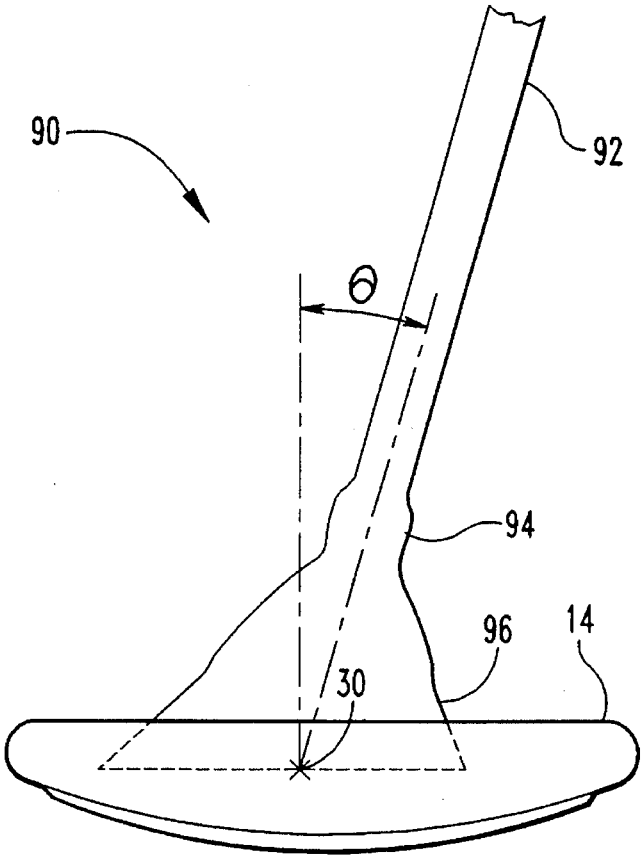
FIG. 10 is a side elevational view of a sixth embodiment putter of the present invention.
Figure 11:
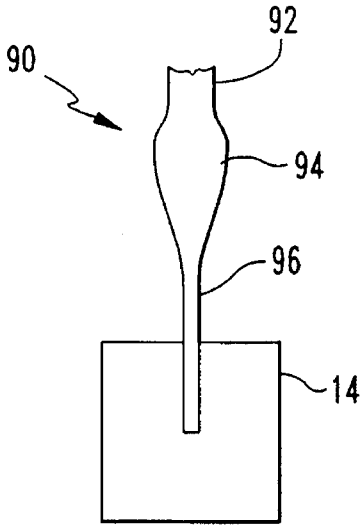
FIG. 11 is a cross-sectional schematic diagram of the sixth embodiment putter of the present invention.

Referring now to FIG. 10, a sixth embodiment putter of the present invention is illustrated, and indicated generally at 90. The putter 90 obviates the need for a separate canopy as in the other embodiments of the present invention. The putter 90 includes a shaft 92, integral canopy section 94 and hosel 96 all integrated into a single continuous piece. Preferably, the shaft 92, integral canopy section 94 and hosel 96 are formed from, graphite. The putter 90 is illustrated in schematic cross-section in FIG. 11. The integral canopy 94 will function similarly to the discreet canopy 20. The thickness of the integral canopy section 94 is selected so that, there is no appreciable bending of the integral canopy section 94 during the collision with the golf ball. In other words, although the graphite shaft 92 and integral canopy section 94 are inherently flexible, substantially all of the deformation occurs in the hosel 96 during collision of the putter blade 14 with the golf ball. By varying the extent to which the thickened integral canopy section 94 extends from the shaft 92, the dynamic flexibility characteristics of the hosel 96 can be adjusted. It will be appreciated by those skilled in the art that the formation of the putter 90 with an integral shaft, canopy and hosel presents a cleaner design and potentially lower assembly costs.

It will be further appreciated by those skilled in the art that the performance characteristics of the putters 10, 50 and 60, as ennumerated hereinabove also apply to the putters 70, 80 and 90 having solid triangular hosels. Additionally, these putters have the further advantage that the blades 14 are less likely to flex away from the line of play when the golf ball is struck away from the center of gravity 30.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A golf putter, comprising:

a shaft;

blade;

split hosel coupling the shaft and the blade; and canopy enclosing a first portion of the shaft and a first portion of the split hosel whereby adjustment of the extent of the canopy over the first portion of the split hosel varies the dynamic characteristics of the split hosel;

wherein the split hosel is formed from a resilient material which deforms when the blade strikes a ball and transfers energy to the ball when the split hosel returns to its quiescent position.

2. The golf putter of claim 1, wherein the resilient material is spring steel.

3. The golf putter of claim 1 wherein the shaft is center shafted.

4. The golf putter of claim 1, wherein the blade is face balanced.

5. The golf putter of claim 1, wherein the split hosel comprises first and second flanges coupled to the blade.

6. The golf putter of claim 5, wherein a first bending radius of the first flange is equal to a second bedding radius of the second flange.

7. The golf putter of claim 5, wherein a first length of the first flange between the canopy and the blade is greater than a second length of the second flange between the canopy and the blade.

8. The putter of claim 1, wherein the split hosel is substantially triangularly shaped.

9. A golf putter, comprising:

a shaft;

a blade;

a split hosel having a first and second flange, wherein the hosel is coupled to the shaft and the first and second flanges are coupled to the blade; and a canopy enclosing a first portion of the shaft and a first portion of the split hosel whereby adjustment of the extent of the canopy over the first portion of the split hosel varies the dynamic characteristics of the split hosel.

10. The golf putter of claim 9, wherein the split hosel is formed from a resilient material which deforms when the blade strikes a ball and transfers energy to the ball when the split hosel returns to its quiescent position.

11. The golf putter of claim 10, wherein the resilient material is spring steel.

12. The golf putter of claim 9, wherein the shaft is center shafted.

13. The golf putter of claim 9, wherein the blade is face balanced.

14. The golf putter of claim 9, wherein a first bending radius of the first flange is equal to a second bending radius of the second flange.

15. The golf putter of claim 9, wherein a first length of the first flange between the canopy and the blade is greater than a second length of the second flange between the canopy and the blade.

16. The golf putter of claim 9, wherein the canopy is formed from epoxy.

17. The golf putter of claim 9, wherein the first and second flanges are of equal length.

18. The golf putter of claim 9, wherein the canopy comprises a first leg extending along the first flange and a second leg extending along the second flange.

19. The golf putter of claim 18, wherein the first leg is longer than the second leg.

20. The putter of claim 9, wherein the split hosel is substantially triangularly shaped.

21. A golf putter, comprising:

a shaft;

a face balanced blade;

a split hosel having a first and second flange, wherein the hosel is coupled to the shaft and the first and second flanges are coupled to the blade such that the putter is center shafted; and canopy enclosing a distal end of the shaft and a proximal end of the split hosel whereby adjustment of the extent of the canopy over the proximal end of the split hosel varies the dynamic characteristics of the split hosel;

wherein the split hosel is formed from a resilient material which deforms when the blade strikes a ball and transfers energy to the ball when the split hosel returns to its quiescent position; and wherein a first bending radius of the first flange is equal to a second bending radius of the second flange.

22. The putter of claim 21, wherein the resilient material is spring steel.

23. The putter of claim 21, wherein the split hosel is substantially triangularly shaped.

24. A golf putter, comprising:

a shaft;

a blade;

a hosel coupling the shaft and the blade, the hosel comprising a solid, substantially triangular member; and a canopy enclosing a first portion of the shaft and a first portion of the hosel whereby adjustment of the extent of the canopy over the first portion of the hosel varies the dynamic characteristics of the hosel;

wherein the hosel is formed from a resilient material which deforms when the blade strikes a ball and transfers energy to the ball when the hosel returns to its quiescent position.

25. The golf putter of claim 24, wherein the resilient material is graphite.

26. The golf putter of claim 24, wherein the shaft is center shafted.

27. The golf putter of claim 24, wherein the blade is face balanced.

28. The golf putter of claim 24, wherein the shaft and the hosel are a single, integral structure.

29. The golf putter of claim 24, wherein the shaft, the canopy and the hosel are a single, integral structure.

30. A golf putter, comprising:

a shaft;

a blade;

a hosel, wherein the hosel is coupled to the shaft and to the blade, the hosel comprising a solid, substantially triangular member; and a canopy enclosing a first portion of the shaft and a first portion of the hosel whereby adjustment of the extent of the canopy over the first portion of the hosel varies the dynamic characteristics of the hosel.

31. The golf putter of claim 30, wherein the hosel is formed from a resilient material which deforms when the blade strikes a ball and transfers energy to the ball when the hosel returns to its quiescent position.

32. The golf putter of claim 31, wherein the resilient material is graphite.

33. The golf putter of claim 30, wherein the shape is center shafted.

34. The golf putter of claim 30, wherein the blade is face balanced.

35. The golf putter of claim 30, wherein the shaft and the hosel are a single, integral structure.

36. The golf putter of claim 30, wherein the shaft, the canopy and the hosel are a single, integral structure.

37. A golf putter, comprising:

a shaft;

a face balanced blade;

a hosel, wherein the hosel is coupled to the shaft and to the blade such that the putter is center shafted; and a canopy enclosing a distal end of the shaft and a proximal end of the hosel whereby adjustment of the extent of the canopy over the proximal end of the hosel varies the dynamic characteristics of the hosel;

wherein the hosel is formed from a resilient material which deforms when the blade strikes a ball and transfers energy to the ball when the hosel returns to its quiescent position.

38. The putter of claim 37, wherein the resilient material is graphite.

39. The putter of claim 37, wherein the hosel is a solid, substantially triangular member.

* * * * *

UNITED STATES PATENT AND TRADEMARK OFFICE

CERTIFICATE OF CORRECTION

PATENT NO. : 5,505,447

DATED : April 9, 1996

INVENTOR(S) : Richard M. Mockovak

It is certified that error appears in the above-identified patent and that said Letters Patent is hereby corrected as shown below:

In column 4, line 50, please delete ",".

In column 5, line 31, please change "still m contact" to --still in contact--.

In column 8, line 29, please add --a-- before "blade".

In column 8, line 30, please add --a-- before "split hosel".

In column 8, line 31, please add --a-- before "canopy".

In column 9, line 39, please add --a-- before "canopy".

In column 10, line 35, please change "shape" to --shaft--.

Signed and Sealed this

Thirteenth Day of August, 1996

*Attest:*

Bruce Lehman

BRUCE LEHMAN

*Attesting Officer*

*Commissioner of Patents and Trademarks*